US011306369B2

(12) United States Patent
Kamo et al.

(10) Patent No.: US 11,306,369 B2
(45) Date of Patent: Apr. 19, 2022

(54) HIGH-STRENGTH STAINLESS STEEL SEAMLESS PIPE FOR OIL COUNTRY TUBULAR GOODS, AND METHOD FOR PRODUCING SAME

(71) Applicant: JFE Steel Corporation, Tokyo (JP)

(72) Inventors: Yuichi Kamo, Tokyo (JP); Masao Yuga, Tokyo (JP); Kenichiro Eguchi, Tokyo (JP); Yasuhide Ishiguro, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 87 days.

(21) Appl. No.: 16/487,203

(22) PCT Filed: Jan. 23, 2018

(86) PCT No.: PCT/JP2018/001868

§ 371 (c)(1),
(2) Date: Aug. 20, 2019

(87) PCT Pub. No.: WO2018/155041

PCT Pub. Date: Aug. 30, 2018

(65) Prior Publication Data

US 2019/0376157 A1 Dec. 12, 2019

(30) Foreign Application Priority Data

Feb. 24, 2017 (JP) ..... JP2017-033009

(51) Int. Cl.

| | |
|---|---|
| ***C21D 9/08*** | (2006.01) |
| ***C21D 6/00*** | (2006.01) |
| ***C21D 8/10*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |
| ***C22C 38/60*** | (2006.01) |

(52) U.S. Cl.

CPC ..... *C21D 9/08* (2013.01); *C21D 6/004* (2013.01); *C21D 8/105* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C22C 38/60* (2013.01); *C21D 2211/001* (2013.01); *C21D 2211/005* (2013.01); *C21D 2211/008* (2013.01)

(58) Field of Classification Search

CPC ..... C21D 9/08; C21D 6/004; C21D 8/105; C21D 2211/001; C21D 2211/005; C21D 2211/008; C22C 38/001; C22C 38/002; C22C 38/005; C22C 38/008; C22C 38/02; C22C 38/04; C22C 38/06; C22C 38/42; C22C 38/44; C22C 38/46; C22C 38/48; C22C 38/50; C22C 38/52; C22C 38/54; C22C 38/60

USPC ..... 148/506

See application file for complete search history.

(56) References Cited

U.S. PATENT DOCUMENTS

| | | | | |
|---|---|---|---|---|
| 5,778,714 | A * | 7/1998 | Katsumura | B21B 25/00 72/209 |
| 7,767,037 | B2 | 8/2010 | Kimura et al. | |
| 7,806,993 | B2 | 10/2010 | Miyazaki et al. | |
| 7,842,141 | B2 | 11/2010 | Kimura et al. | |
| 8,608,872 | B2 | 12/2013 | Kondo et al. | |

(Continued)

FOREIGN PATENT DOCUMENTS

| | | | |
|---|---|---|---|
| CN | 102869803 | A | 1/2013 |
| CN | 104204253 | A | 12/2014 |

(Continued)

OTHER PUBLICATIONS

Boljanovic, Vukota. (2010). Metal Shaping Processes—Casting and Molding; Particulate Processing; Deformation Processes; and Metal Removal—6.4.1 Pierce and Pilger Rolling Process, (pp. 141-143). Industrial Press. (Year: 2010).*

(Continued)

*Primary Examiner* — Brian D Walck
*Assistant Examiner* — Danielle M. Carda
(74) *Attorney, Agent, or Firm* — RatnerPrestia

(57) ABSTRACT

Provided herein is a high-strength stainless steel seamless pipe for oil country tubular goods. The high-strength stainless steel seamless pipe having a yield strength of 862 MPa or more contains, in mass %, C:0.05% or less, Si: 0.5% or less, Mn: 0.15 to 1.0%, P: 0.030% or less, S: 0.005% or less, Cr: 14.5 to 17.5%, Ni: 3.0 to 6.0%, Mo: 2.7 to 5.0%, Cu: 0.3 to 4.0%, W: 0.1 to 2.5%, V: 0.02 to 0.20%, Al: 0.10% or less, N: 0.15% or less, B: 0.0005 to 0.0100%, and the balance Fe and unavoidable impurities, and in which the composition satisfies specific formulas. The stainless steel pipe has more than 45% martensite phase, 10 to 45% ferrite phase, and 30% or less retained austenite phase. The ferrite grains have a maximum crystal grain size of 500 μm or less.

4 Claims, No Drawings

(56) References Cited

U.S. PATENT DOCUMENTS

| | | | | |
|---|---|---|---|---|
| 9,322,087 | B2 | 4/2016 | Takabe et al. | |
| 10,151,011 | B2 | 12/2018 | Eguchi et al. | |
| 10,876,183 | B2 | 12/2020 | Eguchi et al. | |
| 2006/0060270 | A1 | 3/2006 | Klueh et al. | |
| 2006/0243354 | A1 | 11/2006 | Kimura et al. | |
| 2012/0031530 | A1 | 2/2012 | Takabe et al. | |
| 2015/0047831 | A1 | 2/2015 | Nakatsuka et al. | |
| 2015/0152531 | A1 | 6/2015 | Eguchi et al. | |
| 2015/0315684 | A1* | 11/2015 | Eguchi | C22C 38/54 148/506 |
| 2017/0275723 | A1 | 9/2017 | Abe et al. | |
| 2018/0023158 | A1 | 1/2018 | Sasaki et al. | |
| 2019/0100821 | A1 | 4/2019 | Eguchi et al. | |
| 2019/0106775 | A1 | 4/2019 | Nishida et al. | |
| 2019/0177824 | A1 | 6/2019 | Ichikawa et al. | |
| 2019/0177825 | A1 | 6/2019 | Yano et al. | |
| 2019/0296369 | A1 | 9/2019 | Yano et al. | |
| 2019/0305328 | A1 | 10/2019 | Yano et al. | |
| 2019/0368001 | A1 | 12/2019 | Kamo et al. | |
| 2019/0376157 | A1 | 12/2019 | Kamo et al. | |
| 2020/0002779 | A1 | 1/2020 | Yoshino et al. | |
| 2020/0080181 | A1 | 3/2020 | Ichikawa et al. | |
| 2020/0157646 | A1 | 5/2020 | Eguchi et al. | |
| 2020/0216936 | A1 | 7/2020 | Kamo et al. | |

FOREIGN PATENT DOCUMENTS

| | | | | |
|---|---|---|---|---|
| CN | 104411852 | A | | 3/2015 |
| CN | 104937126 | A | | 9/2015 |
| CN | 106282845 | A | * | 1/2017 |
| CN | 106414785 | A | | 2/2017 |
| EP | 2565287 | A1 | | 3/2013 |
| EP | 2832881 | A1 | | 2/2015 |
| EP | 2865777 | A1 | | 4/2015 |
| EP | 2947167 | A1 | | 11/2015 |
| EP | 3121306 | A1 | | 1/2017 |
| JP | 07145452 | A | | 6/1995 |
| JP | 101755 | A | | 1/1998 |
| JP | 2005336595 | A | | 12/2005 |
| JP | 2008081793 | A | | 4/2008 |
| JP | 2010242163 | A | | 10/2010 |
| JP | 2012149317 | A | | 8/2012 |
| JP | 2015096648 | A1 | | 5/2015 |
| JP | 2015110822 | A | | 6/2015 |
| JP | 2015161010 | A | | 9/2015 |
| JP | 2016132789 | A | | 7/2016 |
| JP | 2016172891 | A | | 9/2016 |
| WO | 2010050519 | A1 | | 5/2010 |
| WO | 2010134498 | A1 | | 11/2010 |
| WO | 2014097628 | A1 | | 6/2014 |
| WO | 2016079920 | A1 | | 5/2016 |
| WO | 2016132403 | A1 | | 8/2016 |
| WO | 2017138050 | A1 | | 8/2017 |

OTHER PUBLICATIONS

Translation of CN-106282845-A (Year: 2017).*
Final Office Action for U.S. Appl. No. 16/089,198, dated Feb. 22, 2021, 9 pages.
Extended European Search Report for European Application No. 18758356.2, dated Nov. 25, 2019, 8 pages.
International Search Report and Written Opinion for International Application No. PCT/JP2018/001868, dated Apr. 24, 2018—5 pages.
Chinese Office Action for Chinese Application No. 201880012878.3, dated Nov. 2, 2020 with Concise Statement of Relevance of Office Action, 9 pages.
Final Office Action for U.S. Appl. No. 16/089,198, dated Jul. 8, 2020, 11 pages.
Non Final Office Action for U.S. Appl. No. 16/325,577, dated Aug. 7, 2020, 28 pages.
Non Final Office Action for U.S. Appl. No. 16/615,883, dated Aug. 7, 2020, 28 pages.
Non Final Office Action for U.S. Appl. No. 16/089,198, dated Dec. 1, 2020, 12 pages.
Final Office Action for U.S. Appl. No. 16/325,577, dated Jan. 22, 2021, 27 pages.
Final Office Action for Application No. 16/615,883, dated Jan. 22, 2021, 21 pages.
Non Final Office Action for U.S. Appl. No. 16/089,198, dated Apr. 27, 2020, 24 pages.
Non Final Office Action for U.S. Appl. No. 16/076,138, dated Oct. 28, 2020, 11 pages.
Non Final Office Action for U.S. Appl. No. 16/318,978, dated Oct. 28, 2020, 22 pages.
Non Final Office Action for U.S. Appl. No. 16/615,883, dated Jun. 24, 2021, 27 pages.
Non Final Office Action for U.S. Appl. No. 14/651,952, dated Apr. 5, 2017, 8 pages.
Final Office Action for U.S. Appl. No. 14/651,952, dated Jul. 24, 2017, 6 pages.
Non Final Office Action for U.S. Appl. No. 14/651,952, dated Dec. 7, 2017, 18 pages.
Final Office Action for U.S. Appl. No. 14/651,952, dated Apr. 13, 2018, 17 pages.
Chinese Office Action for Application No. 201880012878.3 dated Jun. 17, 2021 with Concise Statement of Relevance of Office Action, 7 pages.
Non Final Office Action for U.S. Appl. No. 16/089,198, dated Jun. 1, 2021, 12 pages.
Chinese Office Action for Chinese Application No. 201880012878.3, dated Oct. 13, 2021 with Concise Statement of Relevance of Office Action, 7 pages.
Chinese Office Action for Chinese Application No. 201880012878.3, dated Jan. 25, 2022, with Concise Statement of Relevance of Office Action, 6 pages.

* cited by examiner

HIGH-STRENGTH STAINLESS STEEL SEAMLESS PIPE FOR OIL COUNTRY TUBULAR GOODS, AND METHOD FOR PRODUCING SAME

CROSS REFERENCE TO RELATED APPLICATIONS

This is the U.S. National Phase application of PCT/JP2018/001868, filed Jan. 23, 2018, which claims priority to Japanese Patent Application No. 2017-033009, filed Feb. 24, 2017, the disclosures of these applications being incorporated herein by reference in their entireties for all purposes.

FIELD OF THE INVENTION

The present invention relates to a high-strength stainless steel seamless pipe preferred for use in oil and gas well applications such as in crude oil wells and natural gas wells (hereinafter, simply referred to as "oil country tubular goods"). Particularly, the invention relates to a high-strength stainless steel seamless pipe preferred for use in oil country tubular goods and having excellent carbon dioxide corrosion resistance in a severe high-temperature corrosive environment containing carbon dioxide gas ($CO_2$) and chlorine ions ($Cl^-$), and excellent sulfide stress corrosion cracking resistance (SCC resistance) under high temperature, and excellent sulfide stress cracking resistance (SSC resistance) under room temperature in an environment containing hydrogen sulfide ($H_2S$). As used herein, "high-strength" means strength with a yield strength in the order of 125 ksi, specifically a yield strength of 862 MPa or more.

BACKGROUND OF THE INVENTION

Rising crude oil prices, and the increasing shortage of petroleum resources have prompted active development of deep oil fields that was unthinkable in the past, and oil fields and gas fields of a severe corrosive environment, or a sour environment as it is also called, where hydrogen sulfide and other corrosive gases are present. Such oil fields and gas fields are typically very deep, and involve a severe, high-temperature corrosive environment of an atmosphere containing $CO_2$, $Cl^-$, and $H_2S$. Steel pipes materials for oil country tubular goods intended for use in such an environment require high strength, and excellent corrosion resistance (carbon dioxide corrosion resistance, sulfide stress corrosion cracking resistance, and sulfide stress cracking resistance).

Oil country tubular goods used for mining of oil field's and gas fields of an environment containing carbon dioxide gas ($CO_2$), chlorine ions ($Cl^-$), and the like often use 13Cr martensitic stainless steel pipes. Modified 13Cr martensitic stainless steels with a reduced carbon content and increased contents of other components such as Ni and Mo are also in wide use in the last years.

For example, PTL 1 describes a modified martensitic stainless steel (pipe) that improves the corrosion resistance of a 13Cr martensitic stainless steel (pipe). The stainless steel (pipe) described in PTL 1 is a martensitic stainless steel having excellent corrosion resistance and excellent sulfide stress corrosion cracking resistance, and contains, in weight %, C: 0.005 to 0.05%, Si: 0.05 to 0.5%, Mn: 0.1 to 1.0%, P: 0.025% or less, S: 0.015% or less, Cr: 10 to 15%, Ni: 4.0 to 9.0%, Cu: 0.5 to 3%, Mo: 1.0 to 3%, Al: 0.005 to 0.2%, N: 0.005 to 0.1%, and the balance Fe and unavoidable impurities, in which the Ni equivalent (Ni eq.) satisfies $40C+34N+Ni+0.3Cu-1.1Cr-1.8Mo \geq -10$. The martensitic stainless steel has a tempered martensite phase, a martensite phase, and a retained austenite phase, wherein the total fraction of the tempered martensite phase and the martensite phase is 60% or more and 90% or less, and the remainder is the retained austenite phase. This improves the corrosion resistance and the sulfide stress corrosion cracking resistance in a wet carbon dioxide gas environment, and in a wet hydrogen sulfide environment.

There has been development of oil country tubular goods intended for use in a corrosive environment of even higher temperatures (as high as 200° C.). However, with the technique described in PTL 1, the desired corrosion resistance cannot be sufficiently ensured in a stable fashion in such a high-temperature corrosive environment.

This has created a demand for a steel pipe for oil country tubular goods having excellent corrosion resistance and excellent sulfide stress corrosion cracking resistance even when used in a high-temperature corrosive environment. To this end, a wide variety of martensitic stainless steel pipes are proposed.

For example, PTL 2 describes a high-strength stainless steel pipe having excellent corrosion resistance of a composition containing, in mass %, C: 0.005 to 0.05%, Si: 0.05 to 0.5%, Mn: 0.2 to 1.8%, P: 0.03% or less, S: 0.005% or less, Cr: 15.5 to 18%, Ni: 1.5 to 5%, Mo: 1 to 3.5%, V: 0.02 to 0.2%, N: 0.01 to 0.15%, and O: 0.006% or less, wherein the Cr, Ni, Mo, Cu, and C satisfy a specific relational expression, and the Cr, Mo, Si, C, Mn, Ni, Cu, and N satisfy a specific relational expression. The stainless steel pipe has a structure which has a martensite phase as abase phase and contains 10 to 60% ferrite phase, and may further contain 30% or less austenite phase, by volume. In this way, the stainless steel pipe can have sufficient corrosion resistance even in a severe, $CO_2$— and $Cl^-$-containing corrosive environment of a temperature as high as 230° C., and a high-strength and high-toughness stainless steel pipe for oil country tubular goods can be stably produced.

PTL 3 describes a high-strength stainless steel pipe for oil country tubular goods having high toughness and excellent corrosion resistance. The technique described in PTL 3 produces a steel pipe of a composition containing, in mass %, C: 0.04% or less, Si: 0.50% or less, Mn: 0.20 to 1.80%, P: 0.03% or less, S: 0.005% or less, Cr: 15.5 to 17.5%, Ni: 2.5 to 5.5%, V: 0.20% or less, Mo: 1.5 to 3.5%, W: 0.50 to 3.0%, Al: 0.05% or less, N: 0.15% or less, and O: 0.006% or less, wherein the Cr, Mo, W, and C satisfy a specific relational expression, the Cr, Mo, W, Si, C, Mn, Cu, Ni, and N satisfy a specific relational expression, and the Mo and W satisfy a specific relational expression. The high-strength stainless steel pipe has a structure which has a martensite phase as a base phase and contains 10 to 50% ferrite phase by volume. The technique enables producing a high-strength stainless steel pipe for oil country tubular goods having sufficient corrosion resistance even in a severe, $CO_2$—, $Cl^-$—, and $H_2S$-containing high-temperature corrosive environment.

PTL 4 describes a high-strength stainless steel pipe having excellent sulfide stress cracking resistance, and excellent high-temperature carbon dioxide gas corrosion resistance. The technique described in PTL 4 produces a steel pipe of a composition containing, in mass %, C: 0.05% or less, Si: 1.0% or less, S: less than 0.002%, Cr: more than 16% and 18% or less, Mo: more than 2% and 3% or less, Cu: 1 to 3.5%, Ni: 3% or more and less than 5%, Al: 0.001 to 0.1%, and O: 0.01% or less, wherein the Mn and N satisfy a specific relationship in a range of 1% or less of Mn, and 0.05% or less of N. The high-strength stainless steel pipe has a structure that is primarily a martensite phase, and that contains 10 to 40% ferrite phase, and 10% or less retained γ phase by volume. The technique enables producing a high-strength stainless steel pipe having excellent corrosion resistance. The corrosion resistance is sufficient even in a carbon dioxide gas environment of a temperature as high as 200° C., and the stainless steel pipe has sufficient sulfide stress cracking resistance even at lowered ambient gas temperatures.

PTL 5 describes a stainless steel for oil country tubular goods having a proof stress of 758 MPa or more. The stainless steel has a composition containing, in mass %, C: 0.05% or less, Si: 0.5% or less, Mn: 0.01 to 0.5%, P: 0.04% or less, S: 0.01% or less, Cr: more than 16.0 to 18.0%, Ni: more than 4.0 to 5.6%, Mo: 1.6 to 4.0%, Cu: 1.5 to 3.0%, Al: 0.001 to 0.10%, and N: 0.050% or less, wherein the Cr, Cu, Ni, and Mo satisfy a specific relationship, and (C+N), Mn, Ni, Cu, and (Cr+Mo) satisfy a specific relationship. The stainless steel has a structure with a martensite phase, and 10 to 40% by volume of ferrite phase, wherein the proportion of the ferrite phase that crosses a plurality of imaginary segments measuring 50 μm in length from the surface in thickness direction and arranged in lines over a region of 200 μm in a pitch of 10 μm is larger than 85%. In this way, the stainless steel for oil country tubular goods has excellent corrosion resistance in a high-temperature environment, and excellent SCC resistance at room temperature.

PTL 6 describes containing, in mass %, C: 0.05% or less, Si: 0.5% or less, Mn: 0.15 to 1.0%, P: 0.030% or less, S: 0.005% or less, Cr: 15.5 to 17.5%, Ni: 3.0 to 6.0%, Mo: 1.5 to 5.0%, Cu: 4.0% or less, W: 0.1 to 2.5%, and N: 0.15% or less, so as to satisfy $-5.9\times(7.82+27C-0.91Si+0.21Mn-0.9Cr+Ni-1.1Mo+0.2Cu+11N)$ 13.0, $Cu+Mo+0.5W\geq5.8$, and $Cu+Mo+W+Cr+2Ni\leq34.5$. In this way, the high-strength stainless steel seamless pipe can have excellent corrosion resistance, including excellent carbon dioxide corrosion resistance in a $CO_2$— and $Cl^-$-containing high-temperature environment as high as 200° C., and excellent sulfide stress cracking resistance, and excellent sulfide stress corrosion cracking resistance in a $H_2S$-containing corrosive environment.

PATENT LITERATURE

PTL 1: JP-A-H10-1755
PTL 2: JP-A-2005-336595
PTL 3: JP-A-2008-81793
PTL 4: WO2010/050519
PTL 5: WO2010/134498
PTL 6: JP-A-2015-110822

SUMMARY OF THE INVENTION

As the development of oil fields and gas fields of a severe corrosive environment continues, steel pipes for oil country tubular goods are required to have high strength, excellent low-temperature toughness, and excellent corrosion resistance, including carbon dioxide corrosion resistance, and sulfide stress corrosion cracking resistance (SCC resistance) and sulfide stress cracking resistance (SSC resistance), even in a severe, $CO_2$, $Cl^-$—, and $H_2S$-containing high-temperature corrosive environment.

However, it cannot be said that the techniques described in PTL 2 to PTL 5 are satisfactory in terms of providing excellent low-temperature toughness, and sufficient SSC resistance in an environment with a high $H_2S$ partial pressure. This is because crystal grains in a steel pipe material heated before piercing to improve hot workability coarsen when the heating temperature is too high, and fail to provide a high low-temperature toughness value. With low low-temperature toughness, the stainless steel pipe cannot be used in cold climates. When the heating temperature is too low, the lack of ductility causes cracking in the inner and outer surfaces of the steel pipe during pipe manufacture. In oil country tubular goods using such a steel pipe, sufficient SSC resistance cannot be obtained in the event where corrosive ions accumulate in the cracked of the steel, or concentrate as the corrosion progresses. A high low-temperature toughness value cannot be obtained either with the technique described in PTL 6.

Aspects of the present invention are intended to provide solutions to the foregoing problems of the related art, and it is an object according to aspects of the present invention to provide a high-strength stainless steel seamless pipe for oil country tubular goods having high strength and excellent low-temperature toughness, and excellent corrosion resistance including excellent carbon dioxide corrosion resistance, and excellent sulfide stress corrosion cracking resistance and excellent sulfide stress cracking resistance, even in a severe corrosive environment such as described above. Aspects of the invention are also intended to provide a method for producing such a high-strength stainless steel seamless pipe.

As used herein, "high-strength" means a yield strength of 125 ksi (862 MPa) or more.

As used herein, "excellent low-temperature toughness" means having an absorption energy of 100 J or more at −40° C. as measured in a Charpy impact test performed with a V-notch test piece (10 mm thick) according to JIS Z 2242.

As used herein, "excellent carbon dioxide corrosion resistance" means that a test piece dipped in a test solution (20 mass % NaCl aqueous solution; liquid temperature: 200° C.; 30 atm $CO_2$ gas atmosphere) charged into an autoclave has a corrosion rate of 0.125 mm/y or less after 336 hours in the solution.

As used herein, "excellent sulfide stress corrosion cracking resistance" means that a test piece dipped in a test solution (a 20 mass % NaCl aqueous solution; liquid temperature: 100° C.; a 30 atm $CO_2$ gas, and 0.1 atm $H_2S$ atmosphere) having an adjusted pH of 3.3 with addition of an aqueous solution of acetic acid and sodium acetate in an autoclave does not crack even after 720 hours under an applied stress equal to 100% of the yield stress.

As used herein, "excellent sulfide stress cracking resistance" means that a test piece dipped in a test solution (a 20 mass % NaCl aqueous solution; liquid temperature: 25° C.; a 0.9 atm $CO_2$ gas, and 0.1 atm $H_2S$ atmosphere) having an adjusted pH of 3.5 with addition of an aqueous solution of acetic acid and sodium acetate in an autoclave does not crack even after 720 hours under an applied stress equal to 90% of the yield stress.

In order to achieve the foregoing objects, the present inventors conducted intensive studies of stainless steel pipes of a Cr-containing composition from the perspective of corrosion resistance, with regard to various factors that might affect low-temperature toughness at −40° C. The studies found that a high-strength stainless steel seamless pipe having excellent carbon dioxide corrosion resistance and excellent high-temperature sulfide stress corrosion cracking resistance in a high-temperature, $CO_2$—, $Cl^-$—, and $H_2S$-containing corrosive environment as high as 200° C., and in a corrosive environment of a $CO_2$, $Cl^-$, and $H_2S$-containing atmosphere under an applied stress close to the yield strength can, be obtained when the stainless steel pipe has a composite structure that contains more than 45% martensite phase as a primary phase, 10 to 45% ferrite phase and 30% or less retained austenite phase as a secondary phase, by volume.

Another finding is that hot workability improves with a composition containing more than a certain quantity of boron, and that, with such a composition, grain growth during heating can be reduced without causing defects due to reduced ductility, even when a steel pipe material is heated at a temperature of 1,200° C. or less for the production of a seamless steel pipe, as will be described later. With the fine structure, low-temperature toughness improves.

After further studies, the present inventors found that adjusting the C, Si, Mn, Cr, Ni, Mo, Cu, and N contents to satisfy the following formula (1) is important to provide the desired composite structure in a composition containing 14.5 mass % or more of Cr.

$$-5.9\times(7.82+27C-0.91Si+0.21Mn-0.9Cr+Ni-1.1Mo+0.2Cu+11N)\geq 13.0, \quad \text{Formula (1)}$$

wherein C, Si, Mn, Cr, Ni, Mo, Cu, and N represent the content of each element (mass %).

The left-hand side of the formula (1) represents a value experimentally determined by the present inventors as an index that indicates the likelihood of occurrence of the ferrite phase. The present inventors found that adjusting the amount and the type of the alloy elements so as to satisfy the formula (1) is important to achieve the desired composite structure.

It was also found that excessive generation of retained austenite can be reduced, and the desired high-strength and sulfide stress cracking resistance can be provided by adjusting the Cu, Mo, W, Cr, and Ni contents to satisfy the following formula (2).

$$Cu+Mo+W+Cr+2Ni\leq 34.5, \quad \text{Formula (2)}$$

wherein Cu, Mo, W, Cr, and Ni represent the content of each element (mass %).

Another finding is that excellent low-temperature toughness with a Charpy absorption energy at −40° C. of 100 J or more can be achieved when a steel pipe material before piercing is heated at a temperature of 1,200° C. or less during the production of a seamless steel pipe.

With respect to the reasons that a composition having a high Cr content of 14.5 mass % or more, a composite structure containing a martensite phase primarily, a ferrite phase and a retained austenite phase as a secondary phase, and containing Cr, Mo, and W each in an amount not less than a specific amount can have not only excellent carbon dioxide corrosion resistance but excellent sulfide stress corrosion cracking resistance and excellent sulfide stress cracking resistance, the present inventors consider as follows.

The ferrite phase provides excellent pitting corrosion resistance, and precipitates in a laminar fashion in the rolling direction, that is, the axial direction of the pipe. Because the laminar structure is parallel to the direction of applied stress in a sulfide stress cracking test, and a sulfide stress corrosion cracking test, cracks propagate in a manner that divide the laminar structure into two parts. Accordingly, crack propagation is suppressed, and the SSC resistance, and the SCC resistance improve.

Excellent carbon dioxide corrosion resistance occurs when the composition contains a reduced carbon content of 0.05 mass % or less, and 14.5 mass % or more of Cr, 3.0 mass % or more of Ni, and 2.7 mass % or more of Mo.

Aspects of the present invention are based on these findings, and was completed after further studies, and are as follows.

[1] A high-strength stainless steel seamless pipe for oil country tubular goods, the high-strength stainless steel seamless pipe having a yield strength of 862 MPa or more with a composition that comprises, in mass %, C: 0.05% or less, Si: 0.5% or less, Mn: 0.15 to 1.0%, P: 0.030% or less, S: 0.005% or less, Cr: 14.5 to 17.5%, Ni: 3.0 to 6.0%, Mo: 2.7 to 5.0%, Cu: 0.3 to 4.0%, W: 0.1 to 2.5%, V: 0.02 to 0.20%, Al: 0.10% or less, N: 0.15% or less, B: 0.0005 to 0.0100%, and the balance Fe and unavoidable impurities, and in which the C, Si, Mn, Cr, Ni, Mo, Cu, and N satisfy the formula (1) below, and the Cu, Mo, W, Cr, and Ni satisfy the formula (2) below, wherein the stainless steel pipe has a structure that contains more than 45% martensite phase as a primary phase, 10 to 45% ferrite phase and 30% or less retained austenite phase as a secondary phase, by volume, and wherein the ferrite grains have a maximum crystal grain size of 500 μm or less as measured in an inspection of a 100 $mm^2$ continuous region by assuming that grains having a crystal orientation difference of no greater than 15° represent the same grains in electron backscatter diffraction (EBSD).

$$-5.9\times(7.82+27C-0.91Si+0.21Mn-0.9Cr+Ni-1.1Mo+0.2Cu+11N)\geq 13.0, \quad \text{Formula (1)}$$

wherein C, Si, Mn, Cr, Ni, Mo, Cu, and N represent the content of each element (mass %).

$$Cu+Mo+W+Cr+2Ni\leq 34.5, \quad \text{Formula (2)}$$

wherein Cu, Mo, W, Cr, and Ni represent the content of each element (mass %).

[2] The high-strength stainless steel seamless pipe for oil country tubular goods according to the item [1], wherein the composition further comprises, in mass %, at least one selected from Nb: 0.02 to 0.50%, Ti: 0.02 to 0.16%, and Zr: 0.02 to 0.50%.

[3] The high-strength stainless steel seamless pipe for oil country tubular goods according to the item [1] or [2], wherein the composition further comprises, in mass %, at least one selected from REM: 0.001 to 0.05%, Ca: 0.001 to 0.005%, Sn: 0.05 to 0.20%, and Mg: 0.0002 to 0.01%.

[4] The high-strength stainless steel seamless pipe for oil country tubular goods according to any one of the items [1] to [3], wherein the composition further comprises, in mass %, at least one selected from Ta: 0.01 to 0.1%, Co: 0.01 to 1.0%, and Sb: 0.01 to 1.0%.

[5] A method for producing the high-strength stainless steel seamless pipe for oil country tubular goods of any one of the items [1] to [4], the method comprising:

heating a steel pipe material at a heating temperature of 1,200° C. or less;

hot working the steel pipe material to make a seamless steel pipe of a predetermined shape; and quenching and tempering the hot-worked seamless steel pipe in succession.

Aspects of the present invention can provide a high-strength stainless steel seamless pipe having high strength and excellent low-temperature toughness, and further having excellent carbon dioxide corrosion resistance, excellent sulfide stress corrosion cracking resistance and excellent sulfide stress cracking resistance, even in a severe corrosive environment such as described above.

DETAILED DESCRIPTION OF EMBODIMENTS OF THE INVENTION

A high-strength stainless steel seamless pipe for oil country tubular goods according to aspects of the present invention is a high-strength stainless steel seamless pipe having a yield strength of 862 MPa or more, and an absorption energy at −40° C. of 100 J or more as measured by a Charpy impact test, and has a composition that comprises, in mass %, C: 0.05% or less, Si: 0.5% or less, Mn: 0.15 to 1.0%, P: 0.030% or less, S: 0.005% or less, Cr: 14.5 to 17.5%, Ni: 3.0 to 6.0%, Mo: 2.7 to 5.0%, Cu: 0.3 to 4.0%, W: 0.1 to 2.5%, V: 0.02 to 0.20%, Al: 0.10% or less, N: 0.15% or less, B: 0.0005 to 0.0100%, and the balance Fe and unavoidable impurities, in which the C, Si, Mn, Cr, Ni, Mo, Cu, and N satisfy the formula (1) below, and the Cu, Mo, W, Cr, and Ni satisfy the formula (2) below.

$$-5.9\times(7.82+27C-0.91Si+0.21Mn-0.9Cr+Ni-1.1Mo+0.2Cu+11N)\geq 13.0, \quad \text{Formula (1)}$$

wherein C, Si, Mn, Cr, Ni, Mo, Cu, and N represent the content of each element (mass %).

$$Cu+Mo+W+Cr+2Ni\leq 34.5, \quad \text{Formula (2)}$$

wherein Cu, Mo, W, Cr, and Ni represent the content of each element (mass %).

The seamless steel pipe is produced by heating a steel pipe material at a heating temperature of 1,200° C. or less, and the ferrite grains have a maximum grain size of 500 μm or less as measured in an inspection of a 100 $mm^2$ continuous region by assuming that grains having a crystal orientation difference of no greater than 15° represent the same grains in electron backscatter diffraction (EBSD).

The reasons for specifying the composition of the steel pipe according to aspects of the present invention are as follows. In the following, "%" means percent by mass, unless otherwise specifically stated.

C: 0.05% or Less

Carbon is an important element to increase the strength of the martensitic stainless steel. In accordance with aspects of the present invention, carbon is contained in an amount of preferably 0.005% or more to provide the desired strength. A C content of more than 0.05% deteriorates the carbon dioxide corrosion resistance, and the sulfide stress corrosion cracking resistance. For this reason, the C content is 0.05% or less. Preferably, the lower limit of C content is 0.005%, and the upper limit of C content is 0.04%. More preferably, the lower limit of C content is 0.005%, and the upper limit of C content is 0.02%.

Si: 0.5% or Less

Silicon is an element that acts as a deoxidizing agent. This effect is obtained with a Si content of 0.1% or more. A Si content in excess of 0.5% deteriorate hot workability. For this reason, the Si content is 0.5% or less. Preferably, the lower limit of Si content is 0.2%, and the upper limit of Si content is 0.3%.

Mn: 0.15 to 1.0%

Manganese is an element that increases steel strength. In accordance with aspects of the present invention, manganese needs to be contained in an amount of 0.15% or more to provide the desired strength. A Mn content in excess of 1.0% deteriorates toughness. For this reason, the Mn content is 0.15 to 1.0%. Preferably, the lower limit of Mn content is 0.20%, and the upper limit of Mn content is 0.5%. More preferably, the lower limit of Mn content is 0.20%, and the upper limit of Mn content is 0.4%.

P: 0.030% or Less

In accordance with aspects of the present invention, phosphorus should preferably be contained in as small an amount as possible because this element deteriorates corrosion resistance, including carbon dioxide corrosion resistance, pitting corrosion resistance, and sulfide stress cracking resistance. However, a P content of 0.030% or less is acceptable. For this reason, the P content is 0.030% or less, preferably 0.020% or less, more preferably 0.015% or less.

S: 0.005% or Less

Preferably, sulfur should be contained in as small an amount as possible because this element is highly detrimental to hot workability, and interferes with a stable operation of the pipe manufacturing process. However, normal pipe production is possible when the S content is 0.005% or less. For this reason, the S content is 0.005% or less. The S content is preferably 0.002% or less, more preferably 0.0015% or less.

Cr: 14.5 to 17.5%

Chromium is an element that forms a protective coating, and contributes to improving the corrosion resistance. In accordance with aspects of the present invention, chromium needs to be contained in an amount of 14.5% or more to provide the desired corrosion resistance. With a Cr content of more than 17.5%, the ferrite fraction becomes overly high, and it is not possible to provide the desired high strength. It also causes precipitation of intermetallic compounds during tempering, and deteriorates low-temperature toughness. For this reason, the Cr content is 14.5 to 17.5%. Preferably, the lower limit of Cr content is 15.0%, and the upper limit of Cr content is 17.0%. More preferably, the lower limit of Cr content is 15.0%, and the upper limit of Cr content is 16.5%.

Ni: 3.0 to 6.0%

Nickel is an element that adds strength to the protective coating, and improves the corrosion resistance. Nickel also increases steel strength through solid solution strengthening. Such effects are obtained with a Ni content of 3.0% or more. With a Ni content of more than 6.0%, the stability of the martensite phase decreases, and the strength decreases. For this reason, the Ni content is 3.0 to 6.0%. Preferably, the lower limit of Ni content is 3.5%, and the upper limit of Ni content is 5.5%. More preferably, the lower limit of Ni content is 4.0%, and the upper limit of Ni content is 5.5%.

Mo: 2.7 to 5.0%

Molybdenum is an element that improves resistance to pitting corrosion resistance due to $Cl^-$ and low pH, and improves the sulfide stress cracking resistance, and the sulfide stress corrosion cracking resistance. In accordance with aspects of the present invention, molybdenum needs to be contained in an amount of 2.7% or more. With a Mo content of less than 2.7%, sufficient corrosion resistance cannot be obtained in a severe corrosive environment. Molybdenum is an expensive element, and a large Mo content in excess of 5.0% causes precipitation of intermetallic compounds, and deteriorates toughness and pitting corrosion resistance. For this reason, the Mo content is 2.7 to 5.0%. Preferably, the lower limit of Mo content is 3.0%, and the upper limit of Mo content is 5.0%. More preferably, the lower limit of Mo content is 3.3%, and the upper limit of Mo content is 4.7%.

Cu: 0.3 to 4.0%

Copper is an important element that adds strength to the protective coating, and suppresses entry of hydrogen to the steel. Copper also improves the sulfide stress cracking resistance, and the sulfide stress corrosion cracking resistance. Copper needs to be contained in an amount of 0.3% or more to obtain such effects. A Cu content of more than 4.0% leads to precipitation of CuS at grain boundaries, and deteriorates hot workability and corrosion resistance. For this reason, the Cu content is 0.3 to 4.0%. Preferably, the lower limit of Cu content is 1.5%, and the upper limit of Cu content is 3.5%. More preferably, the lower limit of Cu content is 2.0%, and the upper limit of Cu content is 3.0%.

W: 0.1 to 2.5%

Tungsten is a very important element that contributes to improving steel strength. This element also improves the sulfide stress corrosion cracking resistance, and the sulfide stress cracking resistance. When contained together with molybdenum, tungsten improves the sulfide stress cracking resistance. Tungsten needs to be contained in an amount of 0.1% or more to obtain such effects. A large W content of more than 2.5% causes precipitation of intermetallic compounds, and deteriorates toughness. For this reason, the W content is 0.1 to 2.5%. Preferably, the lower limit of W content is 0.8%, and the upper limit of W content is 1.2%. More preferably, the lower limit of W content is 1.0%, and the upper limit of W content is 1.2%.

V: 0.02 to 0.20%

Vanadium is an element that improves steel strength through precipitation strengthening. Such an effect can be obtained when vanadium is contained in an amount of 0.02% or more. A V content of more than 0.20% deteriorates toughness. For this reason, the V content is 0.02 to 0.20%. Preferably, the lower limit of V content is 0.04%, and the upper limit of V content is 0.08%. More preferably, the lower limit of V content is 0.05%, and the upper limit of V content is 0.07%.

Al: 0.10% or Less

Aluminum is an element that acts as a deoxidizing agent. Such an effect can be obtained when aluminum is contained in an amount of 0.001% or more. With an Al content of more than 0.10%, the oxide amount becomes excessive, and the toughness deteriorates. For this reason, the Al content is 0.10% or less. Preferably, the lower limit of Al content is 0.01%, and the upper limit of Al content is 0.06%. More preferably, the lower limit of Al content is 0.02%, and the upper limit of Al content is 0.05%.

N: 0.15% or Less

Nitrogen is an element that highly improves the pitting corrosion resistance. Such an effect becomes more pronounced when nitrogen is contained in an amount of 0.01% or more. A nitrogen content of more than 0.15% results in formation of various nitrides, and the toughness deteriorates. For this reason, the N content is 0.15% or less. The N content is preferably 0.07% or less, more preferably 0.05% or less.

B: 0.0005 to 0.0100%

Boron contributes to increasing strength, and improving hot workability. Boron is contained in an amount of 0.0005% or more to obtain these effects. A boron content of more than 0.0100% produces only a marginal additional hot-workability improving effect, if any, and reduces low-temperature toughness. For this reason, the B content is 0.0005 to 0.0100%. Preferably, the lower limit of B content is 0.0010%, and the upper limit of B content is 0.008%. More preferably, the lower limit of B content is 0.0015%, and the upper limit of B content is 0.007%.

In accordance with aspects of the present invention, the specific components are contained in specific amounts, and C, Si, Mn, Cr, Ni, Mo, Cu, and N satisfy the following formula (1), and Cu, Mo, W, Cr, and Ni satisfy the following formula (2).

$$-5.9\times(7.82+27C-0.91Si+0.21Mn-0.9Cr+Ni-1.1Mo+0.2Cu+11N)\geq 13.0 \quad \text{Formula (1)}$$

In the formula (1), C, Si, Mn, Cr, Ni, Mo, Cu, and N represent the content of each element (mass %).

The left-hand side of the formula (1) represents a value determined as an index that indicates the likelihood of occurrence of the ferrite phase. By containing the alloy elements of formula (1) in adjusted amounts so as to satisfy the formula (1), a composite structure of the martensite phase and the ferrite phase with an additional retained austenite phase can be stably achieved. The amount of each alloy element is therefore adjusted to satisfy the formula (1) in accordance with aspects of the present invention. It should be noted that when the alloy elements shown in formula (1) are not contained, the contents of these elements on the left-hand side of the formula (1) are regarded as 0 percent.

$$Cu+Mo+W+Cr+2Ni\leq 34.5 \quad \text{Formula (2)}$$

In the formula (2), Cu, Mo, W, Cr, and Ni represent the content of each element (mass %).

The left-hand side of the formula (2) represents a value newly derived by the present inventors as an index that indicates the likelihood of occurrence of the retained austenite. When the value on the left-hand side of formula (2) exceeds 34.5, an amount of the retained austenite becomes excessive, and the desired high-strength cannot be provided. The sulfide stress cracking resistance, and the sulfide stress corrosion cracking resistance also deteriorate. For this reason, Cu, Mo, W, Cr, and Ni are adjusted to satisfy the formula (2) in accordance with aspects of the present invention. The value on the left-hand side of the formula (2) is preferably 32.5 or less, more preferably 31 or less.

In addition to the foregoing basic components, the composition contains the balance Fe and unavoidable impurities. Acceptable as unavoidable impurities is O (oxygen): 0.01% or less.

The following optional elements may be contained in accordance with aspects of the present invention, as needed. At least one selected from Nb: 0.02 to 0.50%, Ti: 0.02 to 0.16%, and Zr: 0.02 to 0.50%, and/or at least one selected from REM: 0.001 to 0.05%, Ca: 0.001 to 0.005%, Sn: 0.05 to 0.20%, and Mg: 0.0002 to 0.01%, and/or at least one selected from Ta: 0.01 to 0.1%, Co: 0.01 to 1.0%, and Sb: 0.01 to 1.0%.

At Least One Selected from Nb: 0.02 to 0.50%, Ti: 0.02 to 0.16%, and Zr: 0.02 to 0.50%

Nb, Ti, and Zr are elements that contribute to increasing strength, and may be contained by being selected, as needed.

In addition to increasing strength, niobium contributes to improving toughness. Niobium is contained in an amount of preferably 0.02% or more to provide such effects. A Nb content of more than 0.50% deteriorates toughness. For this reason, niobium, when contained, is contained in an amount of 0.02 to 0.50%.

In addition to increasing strength, titanium contributes to improving sulfide stress cracking resistance. Titanium is contained in an amount of preferably 0.02% or more to obtain such effects. When the titanium content is more than 0.16%, coarse precipitates occur, and the toughness and the sulfide stress corrosion cracking resistance deteriorate. For this reason, titanium, when contained, is contained in an amount of 0.02 to 0.16%.

In addition to increasing strength, zirconium contributes to improving sulfide stress corrosion cracking resistance. Zirconium is contained in an amount of preferably 0.02% or more to obtain such effects. A Zr content of more than 0.50% deteriorates toughness. For this reason, zirconium, when contained, is contained in an amount of 0.02 to 0.50%.

At Least One Selected from REM: 0.001 to 0.05%, Ca: 0.001 to 0.005%, Sn: 0.05 to 0.20%, and Mg: 0.0002 to 0.01%

REM, Ca, Sn, and Mg are elements that contribute to improving sulfide stress corrosion cracking resistance, and may be contained by being selected, as needed. The preferred contents for providing such an effect are 0.001% or more for REM, 0.001% or more for Ca, 0.05% or more for Sn, and 0.0002% or more for Mg. It is not economically advantageous to contain REM in excess of 0.05%, Ca in excess of 0.005%, Sn in excess of 0.20%, and Mg in excess of 0.01% because the effect is not proportional to the content, and becomes saturated. For this reason, REM, Ca, Sn, and Mg, when contained, are contained in amounts of 0.001 to 0.05%, 0.001 to 0.005%, 0.05 to 0.20%, and 0.0002 to 0.01%, respectively.

At Least One Selected from Ta: 0.01 to 0.1%, Co: 0.01 to 1.0%, and Sb: 0.01 to 1.0%

Ta, Co, and Sb are elements that contribute to improving carbon dioxide corrosion resistance ($CO_2$ corrosion resistance), sulfide stress cracking resistance, and sulfide stress corrosion cracking resistance, and may be contained by being selected, as needed. Cobalt also contributes to raising the Ms point, and increasing strength. The preferred contents for providing such effects are 0.01% or more for Ta, 0.01% or more for Co, and 0.01% or more for Sb. The effect is not proportional to the content, and becomes saturated when Ta, Co, and Sb are contained in excess of 0.1%, 1.0%, and 1.0%, respectively. For this reason, Ta, Co, and Sb, when contained, are contained in amounts of 0.01 to 0.1%, 0.01 to 1.0%, and 0.01 to 1.0%, respectively.

The following describes the reasons for limiting the structure of the high-strength stainless steel seamless pipe for oil country tubular goods according to aspects of the present invention.

In addition to the foregoing composition, the high-strength stainless steel seamless pipe for oil country tubular goods according to aspects of the present invention has a structure that contains more than 45% martensite phase (tempered martensite phase) as a primary phase (base phase), 10 to 45% ferrite phase and 30% or less retained austenite phase as a secondary phase, by volume.

In the seamless steel pipe according to aspects of the present invention, the base phase is the martensite phase (tempered martensite phase), and the volume fraction of the martensite phase is more than 45% to provide the desired high strength. In accordance with aspects of the present invention, in order to provide the desired corrosion resistance (carbon dioxide corrosion resistance, sulfide stress cracking resistance (SSC resistance), and sulfide stress corrosion cracking resistance (SCC resistance)), at least 10 to 45% by volume of a ferrite phase is precipitated as a secondary phase to form a duplex phase structure of the martensite phase (tempered martensite phase) and the ferrite phase. This forms a laminar structure along the pipe axis direction, and inhibits crack propagation. The laminar structure does not form, and the desired improvement of corrosion resistance cannot be obtained when the ferrite phase is less than 10%. The desired high strength cannot be provided when the ferrite phase is more than 45%, and forms a precipitate in large quantity. For these reasons, the ferrite phase, which is a secondary phase, is 10 to 45%, preferably 20 to 40% by volume.

In addition to the ferrite phase as the secondary phase, 30% or less by volume of a retained austenite phase is precipitated. Ductility and toughness improve with the presence of the retained austenite phase. The desired high strength cannot be provided when the retained austenite phase is present in abundance with a volume fraction of more than 30%. Preferably, the retained austenite phase is 5% or more and 30% or less by volume.

For the measurement of the structure of the seamless steel pipe according to aspects of the present invention, a test piece for structure observation is corroded with Vilella's reagent (a mixed reagent containing 2 g of picric acid, 10 ml of hydrochloric acid, and 100 ml of ethanol), and the structure is imaged with a scanning electron microscope (magnification: 1,000 times). The fraction of the ferrite phase structure (volume %) is then calculated with an image analyzer.

A test piece for X-ray diffraction is ground and polished to provide a measurement cross sectional surface (C cross section) orthogonal to the pipe axis direction, and the volume of retained austenite (γ) is measured by X-ray diffractometry. The retained austenite volume is calculated by measuring the diffraction X-ray integral intensities of the γ (220) plane and the α (211) plane, and converting the results using the following equation.

$$\gamma(\text{volume fraction})=100/(1+(I\alpha R\gamma/I\gamma R\alpha))$$

In the equation, Iα represents the integral intensity of α, Rα represents a crystallographic theoretical value for α, Iγ represents the integral intensity of γ, and Rγ represents a crystallographic theoretical value for γ.

The fraction of the martensite phase is the fraction other than the ferrite phase, and the retained austenite phase.

In the high-strength stainless steel seamless pipe for oil country tubular goods according to aspects of the present invention, the ferrite grains have a maximum crystal grain size of 500 μm or less as measured in an inspection of a 100 $mm^2$ continuous region by assuming that grains having a crystal orientation difference of no greater than 15° represent the same grains in electron backscatter diffraction (EBSD). When the ferrite grains have a maximum crystal grain size of more than 500 μm, the desired low-temperature toughness cannot be obtained because of reduced numbers of crystal grain boundaries, which interfere with crack propagation. For this reason, the crystal grain size of the steel pipe is 500 μm or less in accordance with aspects of the present invention. The maximum crystal grain size of ferrite grains is preferably 400 μm or less, more preferably 350 μm or less.

The maximum crystal grain size can be determined as follows. In an analysis conducted for a 100 $mm^2$ continuous region, grains having a crystal orientation difference of no greater than 15° are assumed to be the same grains in electron backscatter diffraction (EBSD), and the maximum diameter of the ferrite grains that are assumed to be the same grains is regarded as the crystal grain size of the crystal. The largest value of the crystal grain sizes of all crystals in the 100 $mm^2$ region can then be determined as the maximum crystal grain size. In accordance with aspects of the present invention, the maximum crystal grain size of ferrite grains as measured by EBSD can be adjusted to 500 μm or less by heating a steel pipe material before hot working at a heating temperature of 1,200° C. or less, as will be described later.

A method for producing the high-strength stainless steel seamless pipe for oil country tubular goods according to aspects of the present invention is described below. A method for producing the high-strength stainless steel seamless pipe for oil country tubular goods according to aspects of the present invention includes: heating a steel pipe material at a heating temperature of 1,200° C. or less; hot working the steel pipe material to make a seamless steel pipe of a predetermined shape; and quenching and tempering the hot-worked seamless steel pipe in succession.

A high-strength stainless steel seamless pipe for oil country tubular goods is typically produced by piercing a steel pipe material (e.g., a billet) using a common known tubing producing method, specifically, the Mannesmann-plug mill method or the Mannesmann-mandrel mill method. The steel pipe material is heated to a temperature high enough to provide sufficient ductility because a low steel-pipe-material temperature during piercing often causes defects such as dents, holes, and cracks due to low ductility. However, heating at high temperature causes coarse crystal grain growth, and produces coarse crystal grains in the structure of the final product, with the result that the excellent low-temperature toughness value cannot be obtained.

In accordance with aspects of the present invention, however, the composition containing more than a certain quantity of boron improves hot workability, and the grain growth during heating can be reduced without causing defects due to reduced ductility, even though a steel pipe material is heated at a temperature of 1,200° C. or less. This produces a fine structure, and an excellent low-temperature toughness value can be obtained.

A preferred method for producing a high-strength stainless steel seamless pipe for oil country tubular goods according to aspects of the present invention is described below in order, starting from a starting material. First, a stainless steel seamless pipe of the composition described above is used as a starting material in accordance with aspects of the present invention. The method used to produce the starting material stainless steel seamless pipe is not particularly limited, except for the heating temperature of the steel pipe material.

Preferably, a molten iron of the foregoing composition is made into steel using an ordinary steel making process such as by using a converter, and formed into a steel pipe material, for example, a billet, using an ordinary method such as continuous casting, or ingot casting-breakdown rolling. The steel pipe material is heated to a temperature of 1,200° C. or less, and hot worked using typically a known pipe manufacturing process, for example, such as the Mannesmann-plug mill process, or the Mannesmann-mandrel mill process to produce a seamless steel pipe of the foregoing composition and of the desired dimensions. Here, coarse crystal grain growth occurs, and the low-temperature toughness of the final product reduces when the heat applied during hot working to improve ductility without causing defect is high temperature. It is therefore required to make the heating temperature of the steel pipe material 1,200° C. or less, preferably 1,180° C. or less, more preferably 1,150° C. or less. With a heating temperature of less than 1,050° C., the workability of the steel material becomes considerably poor, and it becomes difficult, even with the steel according to aspects of the present invention, to make a pipe without damaging the outer surface. The heating temperature of the steel pipe material is therefore preferably 1,050° C. or more, more preferably 1,100° C. or more.

After production, the seamless steel pipe is cooled to preferably room temperature at a cooling rate of air cooling or faster. This produces a steel pipe structure having a martensite phase as the base phase. The seamless steel pipe may be produced through hot extrusion by pressing.

Here, "cooling rate of air cooling or faster" means 0.05° C./s or more, and "room temperature" means 40° C. or less.

In accordance with aspects of the present invention, the cooling of the seamless steel pipe to room temperature at a cooling rate of air cooling or faster is followed by quenching, in which the steel pipe is heated to a temperature of 850° C. or more, and cooled to a temperature of 50° C. or less at a cooling rate of air cooling or faster. In this way, the seamless steel pipe can have a structure having a martensite phase as the base phase, and the appropriate volume of ferrite phase. Here, "cooling rate of air cooling or faster" means 0.05° C./s or more, and "room temperature" means 40° C. or less.

The desired high strength cannot be provided when the heating temperature of the quenching is less than 850° C. From the viewpoint of preventing coarsening of the structure, the heating temperature of the quenching is preferably 1,150° C. or less. More preferably, the lower limit of the heating temperature of the quenching is 900° C., and the upper limit of the heating temperature of the quenching is 1,100° C.

The quenching is followed by tempering, in which the seamless steel pipe is heated to a tempering temperature equal to or less than the $Ac_1$ transformation point, and cooled (natural cooling). The tempering that heats the steel pipe to a tempering temperature equal to or less than the $Ac_1$ transformation point, and cools the steel pipe produces a structure having a tempered martensite phase, a ferrite phase, and a retained austenite phase (retained γ phase). The product is the high-strength stainless steel seamless pipe having the desired high strength, high toughness, and excellent corrosion resistance. When the tempering temperature is a high temperature which is above the Act transformation point, the process produces as-quenched martensite, and fails to provide the desired high strength, high toughness, and excellent corrosion resistance. Preferably, tempering temperature is 700° C. or less, preferably 550° C. or more.

EXAMPLES

Aspects of the present invention are further described below through Examples.

Molten irons of the compositions shown in Table 1 were made into steel with a converter, and cast into billets (steel pipe material) by continuous casting. The steel pipe material was then heated, and hot worked with a model seamless rolling machine to produce a seamless steel pipe measuring 83.8 mm in outer diameter and 12.7 mm in wall thickness. This was followed by air cooling. The heating temperature of the steel pipe material before hot working is as shown in Table 2.

Each seamless steel pipe was cut to obtain a test piece material, which was then subjected to quenching, in which the test piece material was heated and cooled under the conditions shown in Table 2. This was followed by tempering, in which the test piece material was heated and air cooled under the conditions shown in Table 2.

A test piece for structure observation was collected from the quenched and tempered test piece material, and corroded with Vilella's reagent (a mixed reagent containing 2 g of picric acid, 10 ml of hydrochloric acid, and 100 ml of ethanol). The structure was imaged with a scanning electron microscope (magnification: 1,000 times), and the fraction of the ferrite phase structure (volume %) was calculated with an image analyzer.

The fraction of the retained austenite phase structure was measured using X-ray diffractometry. A measurement test piece was collected from the quenched and tempered test piece material, and the diffraction X-ray integral intensities of the γ (220) plane and the α (211) plane were measured by X-ray diffractometry. The results were then converted using the following equation.

$$\gamma(\text{volume fraction})=100/(1+(I\alpha R\gamma/I\gamma R\alpha))$$

In the equation, Iα represents the integral intensity of α, Rα represents a crystallographic theoretical value for α, Iγ represents the integral intensity of γ, and Rγ represents a crystallographic theoretical value for γ.

The fraction of the martensite phase was calculated as the fraction other than these phases.

In an analysis conducted for a 100 $mm^2$ continuous region, grains having a crystal orientation difference of no greater than 15° were assumed to be the same grains in electron backscatter diffraction (EBSD), and the maximum diameter of the ferrite grains that were assumed to be the same grains was regarded as the crystal grain size of the crystal. The largest value of the crystal grain sizes of all crystals in the 100 $mm^2$ region was then determined as the maximum crystal grain size.

A strip specimen specified by API standard was collected from the quenched and tempered test piece material, and subjected to a tensile test according to the API specifications to determine its tensile characteristics (yield strength YS, tensile strength TS). Separately, a V-notch test piece (10 mm thick) was collected from the quenched and tempered test piece material according to the JIS Z 2242 specifications. The test piece was subjected to a Charpy impact test, and the absorption energy at −40° C. was determined for toughness evaluation.

A corrosion test piece measuring 3.0 mm in wall thickness, 30 mm in width, and 40 mm in length was machined from the quenched and tempered test piece material, and subjected to a corrosion test.

The corrosion test was conducted by dipping the test piece for 336 hours in a test solution (a 20 mass % NaCl aqueous solution; liquid temperature: 200° C., a 30-atm $CO_2$ gas atmosphere) charged into an autoclave. After the test, the mass of the test piece was measured, and the corrosion rate was determined from the calculated weight reduction before and after the corrosion test. The test piece after the corrosion test was also observed for the presence or absence of pitting corrosion on a test piece surface using a loupe (10 times magnification). Corrosion with a diameter of 0.2 mm or more was regarded as pitting corrosion.

A C-shaped test piece was machined from the quenched and tempered steel pipe according to NACE TM0177, Method C, and subjected to an SSC resistance test. The curved surfaces, which correspond to the inner and outer surfaces of the steel pipe, were not ground or polished.

A 4-point bend test piece measuring 3 mm in thickness, 15 mm in width, and 115 mm in length was collected by machining the quenched and tempered test piece material, and subjected to an SCC resistance test, and an SSC resistance test.

In the SCC (sulfide stress corrosion cracking) resistance test, the test piece was dipped in a test solution (a 20 mass % NaCl aqueous solution; liquid temperature: 100° C.; $H_2S$: 0.1 atm; $CO_2$: 30 atm) having an adjusted pH of 3.3 with addition of an aqueous solution of acetic acid and sodium acetate in an autoclave. The test piece was kept in the solution for 720 hours to apply a stress equal to 100% of the yield stress. After the test, the test piece was observed for the presence or absence of cracking.

In the SSC (sulfide stress cracking) resistance test, the test piece was dipped in a test solution (a 20 mass % NaCl aqueous solution; liquid temperature: 25° C.; $H_2S$: 0.1 atm; $CO_2$: 0.9 atm) having an adjusted pH of 3.5 with addition of an aqueous solution of acetic acid and sodium, acetate. The test piece was kept in the solution for 720 hours to apply a stress equal to 90% of the yield stress.

The results are presented in Table 2.

TABLE 1

| Steel | Composition (mass %) | | | | | | | | | |
|---|---|---|---|---|---|---|---|---|---|---|
| No. | C | Si | Mn | P | S | Cr | Ni | Mo | Cu | W |
| A | 0.012 | 0.30 | 0.26 | 0.013 | 0.0009 | 15.1 | 4.8 | 4.0 | 2.5 | 1.1 |
| B | 0.009 | 0.28 | 0.28 | 0.016 | 0.0008 | 15.3 | 4.9 | 3.6 | 2.5 | 1.1 |
| C | 0.017 | 0.26 | 0.28 | 0.014 | 0.0008 | 15.1 | 4.8 | 3.0 | 2.5 | 1.2 |
| D | 0.011 | 0.21 | 0.24 | 0.015 | 0.0008 | 15.0 | 4.5 | 3.1 | 2.5 | 1.1 |
| E | 0.013 | 0.26 | 0.25 | 0.015 | 0.0010 | 15.1 | 4.7 | 4.3 | 2.6 | 1.3 |
| F | 0.015 | 0.24 | 0.28 | 0.016 | 0.0012 | 14.9 | 4.6 | 4.3 | 2.6 | 1.2 |
| G | 0.010 | 0.23 | 0.29 | 0.014 | 0.0011 | 15.5 | 3.7 | 3.1 | 2.8 | 1.1 |
| H | 0.012 | 0.25 | 0.29 | 0.015 | 0.0009 | 15.0 | 3.8 | 3.0 | 2.6 | 1.3 |
| I | 0.033 | 0.27 | 0.24 | 0.015 | 0.0010 | 15.2 | 3.9 | 3.3 | 2.6 | 0.9 |
| J | 0.005 | 0.29 | 0.28 | 0.016 | 0.0007 | 15.2 | 4.3 | 3.5 | 2.7 | 1.2 |
| K | 0.010 | 0.22 | 0.26 | 0.015 | 0.0007 | 14.9 | 4.2 | 3.6 | 2.5 | 1.1 |
| L | 0.006 | 0.24 | 0.22 | 0.015 | 0.0009 | 15.1 | 4.3 | 3.2 | 2.3 | 1.3 |
| M | 0.006 | 0.26 | 0.21 | 0.014 | 0.0008 | 14.8 | 4.6 | 3.4 | 2.4 | 1.5 |
| N | 0.006 | 0.23 | 0.23 | 0.020 | 0.0007 | 14.9 | 4.6 | 3.5 | 2.4 | 1.2 |
| O | 0.009 | 0.21 | 0.29 | 0.019 | 0.0007 | 15.1 | 4.7 | 3.4 | 2.5 | 1.5 |
| P | 0.015 | 0.28 | 0.29 | 0.014 | 0.0009 | 15.1 | 5.6 | 3.5 | 2.4 | 1.3 |
| Q | 0.015 | 0.29 | 0.21 | 0.013 | 0.0011 | 15.7 | 3.6 | 3.0 | 3.3 | 0.8 |
| R | 0.014 | 0.27 | 0.23 | 0.012 | 0.0009 | 15.6 | 3.4 | 2.9 | 2.6 | 1.5 |
| S | 0.037 | 0.25 | 0.35 | 0.016 | 0.0009 | 16.8 | 3.5 | 2.8 | 0.8 | 1.3 |
| T | 0.015 | 0.22 | 0.31 | 0.011 | 0.0010 | 15.6 | 3.7 | 2.9 | 2.8 | 0.9 |
| U | 0.012 | 0.24 | 0.30 | 0.014 | 0.0009 | 16.1 | 4.1 | 4.1 | 2.5 | 1.2 |
| V | 0.012 | 0.21 | 0.29 | 0.014 | 0.0010 | 14.8 | 2.5 | 3.1 | 2.5 | 0.9 |
| W | 0.033 | 0.27 | 0.29 | 0.014 | 0.0010 | 16.2 | 3.8 | 2.3 | 1.1 | 1.0 |
| X | 0.027 | 0.22 | 0.30 | 0.014 | 0.0013 | 17.8 | 3.6 | 3.0 | 1.3 | 1.1 |
| Y | 0.011 | 0.25 | 0.26 | 0.014 | 0.0009 | 14.8 | 6.2 | 3.6 | 2.6 | 1.0 |
| Z | 0.012 | 0.26 | 0.27 | 0.012 | 0.0009 | 14.8 | 3.8 | 5.5 | 2.4 | 1.1 |
| AA | 0.012 | 0.23 | 0.26 | 0.015 | 0.0010 | 15.5 | 3.6 | 3.1 | 4.3 | 1.1 |
| AB | 0.012 | 0.23 | 0.29 | 0.016 | 0.0008 | 14.2 | 3.2 | 2.9 | 2.6 | 0.9 |
| AC | 0.031 | 0.21 | 0.35 | 0.014 | 0.0014 | 16.3 | 3.6 | 2.9 | 0.1 | 1.0 |
| AD | 0.028 | 0.25 | 0.31 | 0.015 | 0.0009 | 16.8 | 4.1 | 3.0 | 2.7 | 1.0 |
| AE | 0.033 | 0.22 | 0.33 | 0.016 | 0.0010 | 16.1 | 3.4 | 2.9 | 2.7 | - |
| AF | 0.013 | 0.22 | 0.30 | 0.014 | 0.0010 | 15.9 | 4.0 | 3.0 | 2.6 | 1.0 |
| AG | 0.020 | 0.21 | 0.26 | 0.018 | 0.0012 | 17.2 | 4.1 | 3.1 | 2.5 | 1.4 |

TABLE 1-continued

| | | | | | | | | | | |
|---|---|---|---|---|---|---|---|---|---|---|
| AH | 0.009 | 0.23 | 0.33 | 0.019 | 0.0006 | 14.9 | 5.8 | 3.3 | 2.6 | 0.9 |
| AI | 0.025 | 0.21 | 0.31 | 0.018 | 0.0006 | 17.1 | 5.7 | 3.4 | 2.4 | 1.6 |
| AJ | 0.009 | 0.27 | 0.31 | 0.016 | 0.0009 | 15.9 | 4.0 | 3.1 | 2.6 | 1.3 |
| AK | 0.012 | 0.56 | 0.26 | 0.013 | 0.0009 | 15.1 | 4.8 | 4.0 | 2.5 | 1.1 |
| AL | 0.012 | 0.30 | 1.10 | 0.013 | 0.0009 | 15.1 | 4.8 | 4.0 | 2.5 | 1.1 |
| AM | 0.012 | 0.30 | 0.14 | 0.013 | 0.0009 | 15.1 | 4.8 | 4.0 | 2.5 | 1.1 |
| AN | 0.012 | 0.30 | 0.26 | 0.013 | 0.0009 | 14.4 | 4.8 | 4.0 | 2.5 | 1.1 |
| AO | 0.012 | 0.30 | 0.26 | 0.013 | 0.0009 | 15.1 | 2.9 | 4.0 | 2.5 | 1.1 |
| AP | 0.012 | 0.30 | 0.26 | 0.013 | 0.0009 | 15.1 | 4.8 | 2.6 | 2.5 | 1.1 |

| Steel | Composition (mass %) | | | | | | | Value on left-hand side of formula (1) | Value on left-hand side of formula (2) |
|---|---|---|---|---|---|---|---|---|---|
| No. | V | Al | N | B | Nb, Ti, Zr | REM, Ca, Sn, Mg | Ta, Co, Sb | (*1) | (*2) |
| A | 0.048 | 0.017 | 0.011 | 0.0041 | — | — | — | 27.3 | 32.3 |
| B | 0.052 | 0.025 | 0.011 | 0.0025 | — | — | — | 25.6 | 32.3 |
| C | 0.048 | 0.022 | 0.014 | 0.0087 | — | — | — | 19.7 | 31.4 |
| D | 0.047 | 0.021 | 0.008 | 0.0061 | — | — | — | 22.7 | 30.7 |
| E | 0.050 | 0.021 | 0.012 | 0.0025 | Nb: 0.145 | — | — | 29.2 | 32.6 |
| F | 0.047 | 0.023 | 0.013 | 0.0036 | — | — | — | 28.4 | 32.2 |
| G | 0.051 | 0.021 | 0.004 | 0.0023 | — | — | — | 30.2 | 29.9 |
| H | 0.054 | 0.023 | 0.004 | 0.0019 | — | — | — | 26.3 | 29.5 |
| I | 0.050 | 0.023 | 0.062 | 0.0052 | Nb: 0.056 | — | — | 21.8 | 29.8 |
| J | 0.041 | 0.023 | 0.014 | 0.0048 | — | REM: 0.021, Ca: 0.0021 | — | 28.2 | 31.2 |
| K | 0.047 | 0.023 | 0.014 | 0.0034 | — | — | Ta: 0.02, Co: 0.24 | 27.0 | 30.5 |
| L | 0.044 | 0.028 | 0.012 | 0.0029 | Ti: 0.054, Zr: 0.10 | Sn: 0.13, Mg: 0.0007 | — | 26.0 | 30.5 |
| M | 0.046 | 0.021 | 0.013 | 0.0028 | Ti: 0.046 | — | Sb: 0.14 | 24.1 | 31.2 |
| N | 0.042 | 0.024 | 0.015 | 0.0010 | — | Ca: 0.0020, Mg: 0.0009 | Ta: 0.02, Sb: 0.12 | 24.7 | 31.2 |
| O | 0.044 | 0.011 | 0.014 | 0.0040 | Zr: 0.08 | REM: 0.021, Sn: 0.11 | Co: 0.26 | 23.9 | 31.9 |
| P | 0.049 | 0.030 | 0.009 | 0.0050 | — | — | — | 19.1 | 33.5 |
| Q | 0.044 | 0.019 | 0.036 | 0.0037 | — | — | — | 28.1 | 30.0 |
| R | 0.134 | 0.024 | 0.014 | 0.0045 | — | — | — | 30.4 | 29.4 |
| S | 0.059 | 0.027 | 0.012 | 0.0028 | Nb: 0.069 | — | — | 33.9 | 28.7 |
| T | 0.061 | 0.023 | 0.044 | 0.0026 | — | — | — | 25.9 | 29.6 |
| U | 0.041 | 0.025 | 0.016 | 0.0027 | — | — | — | 37.9 | 32.1 |
| V | 0.055 | 0.022 | 0.014 | 0.0029 | — | — | — | 32.9 | 26.3 |
| W | 0.058 | 0.038 | 0.047 | 0.0046 | — | — | — | 23.8 | 28.2 |
| X | 0.053 | 0.041 | 0.048 | 0.0038 | — | — | — | 38.5 | 30.4 |
| Y | 0.061 | 0.019 | 0.009 | 0.0051 | — | — | — | 14.8 | 34.4 |
| Z | 0.054 | 0.018 | 0.009 | 0.0041 | — | — | — | 41.5 | 31.4 |
| AA | 0.058 | 0.019 | 0.009 | 0.0011 | — | — | — | 28.4 | 31.2 |
| AB | 0.052 | 0.021 | 0.014 | 0.0029 | — | — | — | 24.2 | 27.0 |
| AC | 0.049 | 0.032 | 0.056 | 0.0030 | — | — | — | 30.0 | 27.5 |
| AD | 0.012 | 0.034 | 0.043 | 0.0035 | — | — | — | 28.9 | 31.7 |
| AE | 0.059 | 0.044 | 0.041 | 0.0049 | — | — | — | 27.8 | 28.5 |
| AF | 0.112 | 0.028 | 0.028 | 0.0150 | — | — | — | 28.0 | 29.5 |
| AG | 0.059 | 0.029 | 0.022 | 0.0003 | — | — | — | 34.4 | 31.0 |
| AH | 0.081 | 0.024 | 0.070 | 0.0053 | — | — | — | 12.0 | 33.3 |
| AI | 0.056 | 0.044 | 0.012 | 0.0020 | — | — | — | 26.2 | 35.9 |
| AJ | 0.053 | 0.026 | 0.023 | 0.0026 | — | — | — | 29.9 | 30.9 |
| AK | 0.048 | 0.017 | 0.011 | 0.0041 | — | — | — | 28.7 | 32.3 |
| AL | 0.048 | 0.017 | 0.011 | 0.0041 | — | — | — | 26.3 | 32.3 |
| AM | 0.048 | 0.017 | 0.011 | 0.0041 | — | — | — | 27.5 | 32.3 |
| AN | 0.048 | 0.017 | 0.011 | 0.0041 | — | — | — | 23.6 | 31.6 |
| AO | 0.048 | 0.017 | 0.011 | 0.0041 | — | — | — | 38.6 | 28.5 |
| AP | 0.048 | 0.017 | 0.011 | 0.0041 | — | — | — | 18.3 | 30.9 |

The balance is Fe and unavoidable impunties (*1) Value on the left-hand side of formula (1) = −5.9 × (7.82 + 27C − 0.91Si + 0.21Mn − 0.9Cr + Ni − 1.1Mo + 0.2Cu + 11N) (In the formula, C, Si, Mn, Cr, Ni, Mo, Cu, and N represent the content of each element (mass %))

(*2) Value on the left-hand side of formula (2) = Cu + Mo + W + Cr + 2Ni (In the formula, Cu, Mo, W, Cr, and Ni represent the content of each element (mass %)

Underline means outside the range of the present invention.

TABLE 2

| | | Steel pipe material | Quenching | | Tempering | | | | |
|---|---|---|---|---|---|---|---|---|---|
| | Steel | heating | Heating | Holding | Heating | Holding | Structure (volume %) | | |
| Steel No. | pipe No. | temperature (° C.) | temperature (° C.) | time (min) | temperature (° C.) | time (min) | M (*1) | F (*1) | A (*1) |
| A | 1 | 1180 | 1050 | 20 | 575 | 30 | 61 | 31 | 8 |
| B | 2 | 1180 | 1030 | 20 | 575 | 30 | 65 | 30 | 5 |

TABLE 2-continued

| | | | | | | | | | |
|---|---|---|---|---|---|---|---|---|---|
| C | 3 | 1180 | 1000 | 20 | 565 | 30 | 67 | 29 | 4 |
| D | 4 | 1180 | 1000 | 20 | 565 | 30 | 61 | 34 | 5 |
| E | 5 | 1150 | 1050 | 20 | 570 | 30 | 49 | 43 | 8 |
| F | 6 | 1150 | 1050 | 20 | 570 | 30 | 58 | 35 | 7 |
| G | 7 | 1150 | 980 | 20 | 590 | 30 | 67 | 31 | 2 |
| H | 8 | 1150 | 1000 | 20 | 560 | 30 | 66 | 32 | 2 |
| I | 9 | 1150 | 980 | 20 | 580 | 30 | 64 | 30 | 6 |
| J | 10 | 1180 | 1030 | 20 | 575 | 30 | 66 | 29 | 5 |
| K | 11 | 1180 | 1030 | 20 | 575 | 30 | 65 | 30 | 5 |
| L | 12 | 1180 | 1010 | 20 | 575 | 30 | 65 | 32 | 3 |
| M | 13 | 1180 | 1030 | 20 | 575 | 30 | 68 | 29 | 3 |
| N | 14 | 1180 | 1030 | 20 | 575 | 30 | 64 | 32 | 4 |
| O | 15 | 1180 | 1030 | 20 | 575 | 30 | 62 | 32 | 6 |
| P | 16 | 1150 | 1050 | 20 | 575 | 30 | 64 | 25 | 11 |
| Q | 17 | 1150 | 980 | 20 | 590 | 30 | 72 | 26 | 2 |
| R | 18 | 1150 | 1000 | 20 | 560 | 30 | 66 | 31 | 3 |
| S | 19 | 1150 | 970 | 20 | 560 | 30 | 56 | 38 | 6 |
| T | 20 | 1150 | 980 | 20 | 590 | 30 | 64 | 36 | 0 |
| W | 23 | 1180 | 970 | 20 | 560 | 30 | 65 | 30 | 5 |
| X | 24 | 1180 | 970 | 20 | 560 | 30 | 50 | 46 | 4 |
| Y | 25 | 1150 | 1050 | 20 | 575 | 30 | 49 | 21 | 20 |
| Z | 26 | 1150 | 1080 | 20 | 580 | 30 | 54 | 36 | 10 |
| AA | 27 | 1150 | 980 | 20 | 590 | 30 | 59 | 35 | 6 |
| AB | 28 | 1150 | 960 | 20 | 570 | 30 | 65 | 35 | 0 |
| AC | 29 | 1180 | 970 | 20 | 555 | 30 | 64 | 33 | 3 |
| AD | 30 | 1180 | 970 | 20 | 560 | 30 | 62 | 30 | 8 |
| AE | 31 | 1180 | 970 | 20 | 560 | 30 | 67 | 32 | 1 |
| AF | 32 | 1180 | 1000 | 20 | 595 | 30 | 60 | 31 | 9 |
| AG | 33 | 1180 | 1040 | 20 | 550 | 30 | 58 | 27 | 15 |
| AJ | 36 | 1230 | 1000 | 20 | 575 | 30 | 60 | 22 | 18 |
| AK | 37 | 1180 | 960 | 20 | 570 | 30 | 65 | 25 | 10 |
| AL | 38 | 1180 | 960 | 20 | 570 | 30 | 67 | 24 | 9 |
| AM | 39 | 1180 | 960 | 20 | 570 | 30 | 65 | 25 | 10 |
| AN | 40 | 1180 | 960 | 20 | 570 | 30 | 65 | 26 | 9 |
| AO | 41 | 1180 | 960 | 20 | 570 | 30 | 68 | 23 | 9 |
| AP | 42 | 1180 | 960 | 20 | 570 | 30 | 67 | 24 | 9 |

| Steel No. | Maximum crystal grain size of ferrite grains (μm) (*2) | Yield strength YS (MPa) | Tensile strength TS (MPa) | $vE_{-40}$ (J) | Corrosion rate (mm/y) | Pitting corrosion | SSC | SCC | Remarks |
|---|---|---|---|---|---|---|---|---|---|
| A | 289 | 977 | 1052 | 154 | 0.033 | Absent | ○ | ○ | Present example |
| B | 267 | 952 | 1012 | 156 | 0.035 | Absent | ○ | ○ | Present example |
| C | 244 | 963 | 1013 | 186 | 0.035 | Absent | ○ | ○ | Present example |
| D | 239 | 969 | 1018 | 130 | 0.029 | Absent | ○ | ○ | Present example |
| E | 296 | 954 | 1066 | 105 | 0.033 | Absent | ○ | ○ | Present example |
| F | 294 | 948 | 1082 | 122 | 0.044 | Absent | ○ | ○ | Present example |
| G | 260 | 886 | 953 | 152 | 0.036 | Absent | ○ | ○ | Present example |
| H | 279 | 968 | 1028 | 156 | 0.027 | Absent | ○ | ○ | Present example |
| I | 265 | 958 | 1135 | 147 | 0.050 | Absent | ○ | ○ | Present example |
| J | 266 | 970 | 1024 | 126 | 0.036 | Absent | ○ | ○ | Present example |
| K | 260 | 972 | 1018 | 160 | 0.032 | Absent | ○ | ○ | Present example |
| L | 249 | 964 | 1018 | 172 | 0.025 | Absent | ○ | ○ | Present example |
| M | 266 | 926 | 1021 | 171 | 0.045 | Absent | ○ | ○ | Present example |
| N | 271 | 970 | 1009 | 153 | 0.033 | Absent | ○ | ○ | Present example |
| O | 273 | 950 | 1030 | 186 | 0.028 | Absent | ○ | ○ | Present example |
| P | 288 | 916 | 1062 | 175 | 0.031 | Absent | ○ | ○ | Present example |
| Q | 270 | 931 | 1053 | 123 | 0.031 | Absent | ○ | ○ | Present example |
| R | 276 | 934 | 1034 | 110 | 0.027 | Absent | ○ | ○ | Present example |
| S | 261 | 920 | 1055 | 117 | 0.019 | Absent | ○ | ○ | Present example |
| T | 265 | 958 | 1007 | 107 | 0.034 | Absent | ○ | ○ | Present example |
| W | 266 | 862 | 1016 | 106 | 0.030 | Absent | x | x | Comparative example |
| X | 263 | 842 | 1023 | 32 | 0.010 | Absent | ○ | ○ | Comparative example |
| Y | 258 | 850 | 1039 | 230 | 0.030 | Absent | ○ | ○ | Comparative example |
| Z | 270 | 912 | 1043 | 30 | 0.030 | Present | x | x | Comparative example |
| AA | 249 | 916 | 1017 | 131 | 0.038 | Absent | x | x | Comparative example |
| AB | 246 | 942 | 1020 | 115 | 0.139 | Present | x | x | Comparative example |
| AC | 271 | 936 | 1019 | 123 | 0.027 | Absent | x | x | Comparative example |
| AD | 263 | 854 | 1058 | 122 | 0.016 | Absent | ○ | ○ | Comparative example |
| AE | 270 | 847 | 1048 | 157 | 0.041 | Present | x | x | Comparative example |
| AF | 277 | 901 | 1015 | 51 | 0.019 | Absent | ○ | ○ | Comparative example |
| AG | 324 | 886 | 981 | 111 | 0.046 | Absent | x | ○ | Comparative example |
| AJ | 518 | 870 | 998 | 42 | 0.011 | Absent | ○ | ○ | Comparative example |
| AK | 264 | 888 | 1001 | 121 | 0.078 | Absent | x | ○ | Comparative example |
| AL | 257 | 901 | 1012 | 60 | 0.058 | Absent | ○ | ○ | Comparative example |
| AM | 251 | 845 | 931 | 109 | 0.061 | Absent | ○ | ○ | Comparative example |
| AN | 270 | 920 | 1055 | 117 | 0.153 | Present | x | x | Comparative example |

TABLE 2-continued

| | | | | | | | | | |
|---|---|---|---|---|---|---|---|---|---|
| AO | 266 | 832 | 945 | 108 | 0.132 | Absent | x | x | Comparative example |
| AP | 260 | 916 | 1062 | 175 | 0.098 | Absent | x | x | Comparative example |

(*1) M: Martensite phase, F: Ferrite phase, A: Retained austenite phase (*2) maximum crystal grain size of ferrite grains as measured in an inspection of a 100 $mm^2$ continuous region by assuming that grains having a crystal orientation difference of no greater than 15° represent the same grains in electron backscatter diffraction (EBSD).

Underline means outside the range of the present invention.

The high-strength stainless steel seamless pipes of the present examples all had high strength with a yield strength of 862 MPa or more, high toughness with an absorption energy at −40° C. of 100 J or more, and excellent corrosion resistance (carbon dioxide corrosion resistance) in a high-temperature, $CO_2$— and $Cl^-$-containing 200° C. corrosive environment. The high-strength stainless steel seamless pipes of the present examples produced no cracks (SSC, SCC) in the $H_2S$-containing environment, and had excellent sulfide stress cracking resistance, and excellent sulfide stress corrosion cracking resistance.

On the other hand, comparative examples outside of the range of the present invention did not have at least one of the desired high strength, low-temperature toughness, carbon dioxide corrosion resistance, sulfide stress cracking resistance (SSC resistance), and sulfide stress corrosion cracking resistance (SCC resistance).

Steel pipe No. 23 (steel No. W) had a Mo content of less than 2.7 mass %, and the desired SSC resistance and SCC resistance were not obtained.

Steel pipe No. 24 (steel No. X) had a Cr content of more than 17.5 mass %, and the ferrite phase exceeded 45%. The yield strength YS was less than 862 MPa, and the vE-40 was less than 100 J.

Steel pipe No. 25 (steel No. Y) had a Ni content of more than 6.0 mass %, and the yield strength YS was less than 862 MPa.

Steel pipe No. 26 (steel No. Z) had a Mo content of more than 5.0 mass %, and the vE-40 was less than 100 J. As a result, pitting corrosion occurred, and the desired SSC resistance and SCC resistance were not obtained.

Steel pipe No. 27 (steel No. AA) had a Cu content of more than 4.0 mass %, and the desired SSC resistance and SCC resistance were not obtained.

Steel pipe No. 28 (steel No. AB) had a Cr content of less than 14.5 mass %. As a result, pitting corrosion occurred, and the desired SSC resistance and SCC resistance were not obtained.

Steel pipe No. 29 (steel No. AC) had a Cu content of less than 0.3 mass %, and the desired SSC resistance and SCC resistance were not obtained.

Steel pipe No. 30 (steel No. AD) had a V content of less than 0.02 mass %, and the yield strength YS was less than 862 MPa.

Steel pipe No. 31 (steel No. AE) had a W content of less than 0.1 mass %, and the yield strength YS was less than 862 MPa. As a result, pitting corrosion occurred, and the desired SSC resistance and SCC resistance were not obtained.

Steel pipe No. 32 (steel No. AF) had a B content of more than 0.0100 mass %, and the vE-40 was less than 100 J.

Steel pipe No. 33 (steel No. AG) had a B content of less than 0.0005 mass %, and the hot workability was insufficient. As a result, damage occurred during pipe manufacture, and the desired SSC resistance was not obtained.

Steel pipe No. 36 had a heating temperature of more than 1,200° C. The maximum crystal grain size of ferrite grains exceeded 500 μm, and the vE-40 was less than 100 J.

Steel pipe No. 37 had a Si content of more than 0.5 mass %, and the hot workability was insufficient. As a result, damage occurred during pipe manufacture, and the desired SSC resistance was not obtained.

Steel pipe No. 38 had a Mn content of more than 1.0 mass %, and the vE-40 was less than 100 J.

Steel pipe No. 39 had a Mn content of less than 0.15 mass %, and the yield strength YS was less than 862 MPa.

Steel pipe No. 40 had a Cr content of less than 14.5 mass %, and the desired carbon dioxide corrosion resistance, the desired pitting corrosion resistance, and the desired SSC and SCC resistances were not obtained.

Steel pipe No. 41 had a Ni content of less than 3.0 mass %. The yield strength YS was less than 862 MPa, and the desired carbon dioxide corrosion resistance, the desired pitting corrosion resistance, and the desired SSC and SCC resistances were not obtained.

Steel pipe No. 42 had a Mo content of less than 2.7 mass %, and the desired SSC and SCC resistances were not obtained.

The invention claimed is:

1. A high-strength stainless steel seamless pipe for oil country tubular goods, the high-strength stainless steel seamless pipe having a yield strength of 862 MPa or more with a composition that comprises, in mass %, C:0.05% or less, Si: 0.5% or less, Mn: 0.15 to 1.0%, P:0.030% or less, S:0.005% or less, Cr: 14.5 to 17.5%, Ni: 3.0 to 6.0%, Mo: 2.7 to 5.0%, Cu: 0.3 to 4.0%, W:0.1 to 2.5%, V: 0.02 to 0.20%, Al: 0.10% or less, N: 0.15% or less, B: 0.0005 to 0.0100%, and the balance Fe and unavoidable impurities, and in which the C, Si, Mn, Cr, Ni, Mo, Cu, and N satisfy the formula (1) below, and the Cu, Mo, W, Cr, and Ni satisfy the formula (2) below, wherein the high-strength stainless steel seamless pipe has a high toughness with an absorption energy at −40° C. of 100 J or more, wherein the high-strength stainless steel seamless pipe has a structure that contains more than 45% martensite phase as a primary phase, 10 to 45% ferrite phase and 30% or less retained austenite phase as a secondary phase, by volume, and wherein the ferrite grains have a maximum crystal grain size of 500 μm or less as measured in an inspection of a 100 $mm^2$ continuous region by assuming that grains having a crystal orientation difference of no greater than 15° represent the same grains in electron backscatter diffraction, EBSD:

$$-5.9\times(7.82+27C-0.91Si+0.21Mn-0.9Cr+Ni-1.1Mo+0.2Cu+11N)\geq 3.0, \quad \text{Formula (1)}$$

wherein C, Si, Mn, Cr, Ni, Mo, Cu, and N represent the content of each element in mass %; and $$Cu+Mo+W+Cr+2Ni\leq 34.5, \quad \text{Formula (2)}$$

wherein Cu, Mo, W, Cr, and Ni represent the content of each element in mass %.

2. The high-strength stainless steel seamless pipe for oil country tubular goods according to claim 1, wherein the composition further comprises, in mass %, one, two, or all selected from the following groups A to C:

group A:

at least one selected from Nb: 0.02 to 0.50%, Ti: 0.02 to 0.16%, and Zr: 0.02 to 0.50% group B:

at least one selected from REM: 0.001 to 0.05%, Ca: 0.001 to 0.005%, Sn: 0.05 to 0.20%, and Mg: 0.0002 to 0.01% group C:

at least one selected from Ta: 0.01 to 0.1%, Co: 0.01 to 1.0%, and Sb:0.01 to 1.0%.

3. A method for producing the high-strength stainless steel seamless pipe for oil country tubular goods of claim 1, the method comprising:

heating a steel pipe material at a heating temperature of 1,200° C. or less;

hot working the steel pipe material to make a seamless steel pipe of a predetermined shape; and quenching and tempering the hot-worked seamless steel pipe in succession.

4. A method for producing the high-strength stainless steel seamless pipe for oil country tubular goods of claim 2, the method comprising:

heating a steel pipe material at a heating temperature of 1,200° C. or less;

hot working the steel pipe material to make a seamless steel pipe of a predetermined shape; and quenching and tempering the hot-worked seamless steel pipe in succession.

* * * * *